US007086480B2

(12) United States Patent
Simpson et al.

(10) Patent No.: US 7,086,480 B2
(45) Date of Patent: Aug. 8, 2006

(54) TUBING ANCHOR

(75) Inventors: Neil Andrew Abercrombie Simpson, Scotland (GB); Alexander Craig Mackay, Scotland (GB); Graham Mackay, Scotland (GB); Duncan James Trinder, Scotland (GB)

(73) Assignee: Weatherford/Lamb, Inc., Houston, TX (US)

( * ) Notice: Subject to any disclaimer, the term of this patent is extended or adjusted under 35 U.S.C. 154(b) by 178 days.

(21) Appl. No.: 10/428,211

(22) Filed: May 2, 2003

(65) Prior Publication Data

US 2003/0205387 A1 Nov. 6, 2003

(30) Foreign Application Priority Data

May 3, 2002 (GB) ..... 0210256

(51) Int. Cl.
*E21B 23/01* (2006.01)

(52) U.S. Cl. ..... 166/382; 166/207; 166/208

(58) Field of Classification Search ..... 166/382, 166/380, 206, 207, 208
See application file for complete search history.

(56) References Cited

U.S. PATENT DOCUMENTS

| | | | | |
|---|---|---|---|---|
| 1,751,090 | A * | 3/1930 | Nelson | 294/86.19 |
| 2,155,973 | A | 4/1939 | Irwine et al. | |
| 2,323,989 | A | 7/1943 | Fulkerson | |
| 2,616,503 | A * | 11/1952 | Armentrout | 166/104 |
| 3,067,819 | A * | 12/1962 | Gore | 166/387 |
| 3,203,483 | A | 8/1965 | Vincent | |
| 3,294,122 | A | 12/1966 | Sharp | |
| 3,353,599 | A * | 11/1967 | Swift | 166/278 |
| 3,437,246 | A | 4/1969 | Clapp | |
| 3,560,117 | A | 2/1971 | Valbjom et al. | |
| 3,863,939 | A | 2/1975 | Sato | |
| 4,012,092 | A | 3/1977 | Godbey | |
| 4,424,865 | A * | 1/1984 | Payton, Jr. | 166/302 |
| 4,903,993 | A | 2/1990 | Brammer | |
| 5,083,608 | A | 1/1992 | Abdrakhmanov et al. | |
| 5,095,991 | A * | 3/1992 | Milberger | 166/380 |
| 6,098,717 | A | 8/2000 | Bailey et al. | 166/382 |
| 6,112,818 | A * | 9/2000 | Campbell | 166/384 |

(Continued)

FOREIGN PATENT DOCUMENTS

| | | |
|---|---|---|
| DE | 464 931 | 9/1928 |

(Continued)

OTHER PUBLICATIONS

International Search Report for GB 0210256.4, dated Sep. 10, 2002.

(Continued)

*Primary Examiner*—Hoang Dang
(74) *Attorney, Agent, or Firm*—Patterson & Sheridan, L.L.P.

(57) ABSTRACT

A method of anchoring tubing in a bore comprises: providing first tubing having a section with a wall configured to provide outer surface portions describing a diameter less than a first diameter. The tubing is located within a bore comprising a first section having an internal diameter greater than the first diameter and a second section having an internal diameter corresponding to the first diameter, with the tubing section in the first section of the bore. The tubing section is then reconfigured such that the outer surface portions describe a tubing diameter greater than the first diameter. The tubing is then axially translated relative to the bore to locate the tubing section in the second section of the bore such that the outer surface portions are restrained to the first diameter by the bore, and the outer surface portions engage with the bore.

61 Claims, 1 Drawing Sheet

U.S. PATENT DOCUMENTS

| | | | | |
|---|---|---|---|---|
| 6,550,539 | B1 | 4/2003 | Maguire et al. | |
| 6,742,606 | B1 * | 6/2004 | Metcalfe et al. | 175/57 |
| 2001/0020532 | A1 * | 9/2001 | Baugh et al. | 166/285 |
| 2003/0188874 | A1 * | 10/2003 | Gabrysch et al. | 166/380 |

FOREIGN PATENT DOCUMENTS

| | | | |
|---|---|---|---|
| GB | 2368866 | | 5/2002 |
| RU | 2144128 | C1 | 1/2000 |
| SU | 6683825 | | 5/1979 |
| SU | 989038 | | 1/1983 |
| SU | 1745873 | A1 | 7/1992 |
| WO | WO 93 25799 | | 12/1993 |
| WO | WO 00 37766 | | 6/2000 |
| WO | WO 02 04783 | | 1/2002 |

OTHER PUBLICATIONS

International Search Report, Application No. GB 03/01881, dated Dec. 16, 2003.

International Search Report, Application No. GB 03/01879, dated Dec. 16, 2003.

* cited by examiner

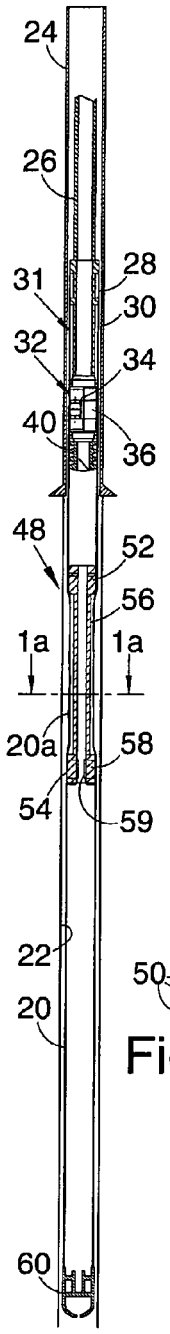
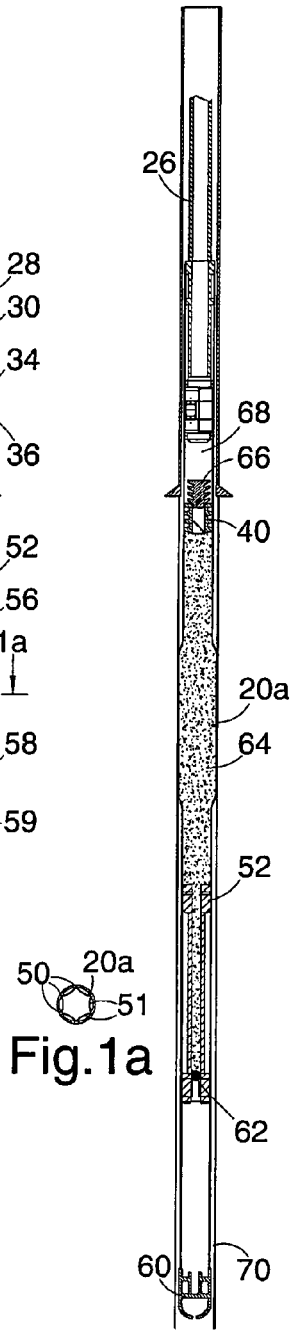
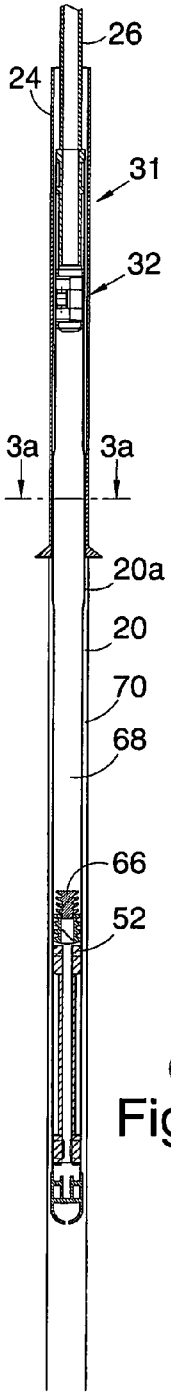
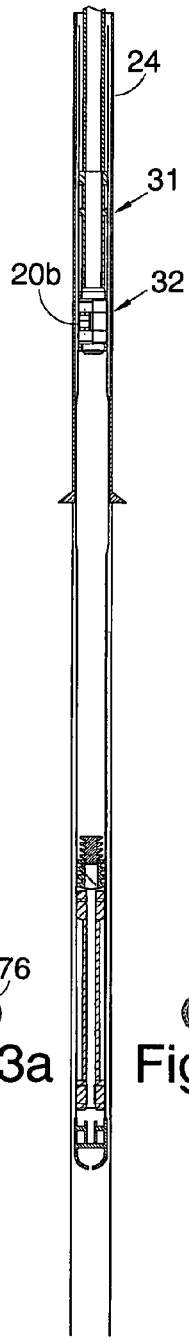
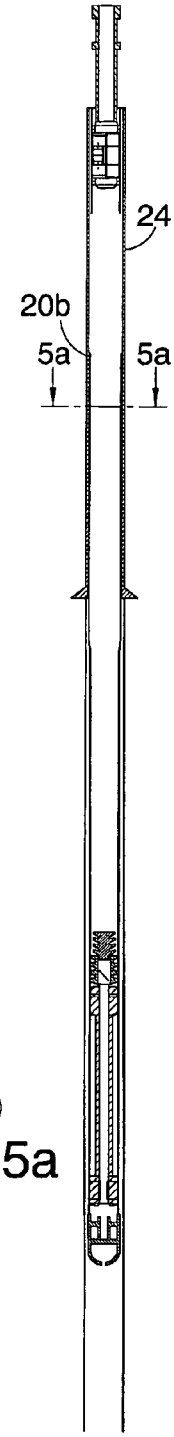
Fig.1a
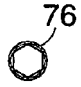
Fig.3a
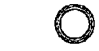
Fig.5a
Fig.1 Fig.2 Fig.3 Fig.4 Fig.5

TUBING ANCHOR

BACKGROUND OF THE INVENTION

A recent development in the oil and gas exploration and production industry has been the adoption of expandable bore-lining tubing. This involves running tubing into an open section of bore and then expanding at least a portion of the tubing to a larger diameter. Typically, the upper end of the tubing will overlap the lower end of existing bore-lining casing or liner. In a number of proposals, the upper end of the tubing is expanded initially to create a tubing hanger which serves to fix the tubing in the bore so that the tubing may be disengaged from the running string used to carry the tubing into the bore. Other operations, such as cementing the tubing, or expanding other portions of the tubing, may then take place.

The present applicant has identified that there are certain difficulties involved in creating the initial anchor, particularly in previously cemented tubing. A number of existing proposals suggest the use of radially extendable members for radially extending circumferentially spaced portions of the tubing, to bring the outer surfaces of these portions into engagement with the surrounding casing. However, in any such deformation of metallic tubing, there is a degree of elastic recovery of the tubing once the deforming force has been removed. Thus, the desired degree of engagement between the tubing and the casing may not be achieved.

FIELD OF THE INVENTION

This invention relates to tubing anchors. In particular the invention relates to an apparatus and method of anchoring one tubing within another, most particularly at a downhole location.

SUMMARY OF THE INVENTION

According to a first aspect of the present invention there is provided a method of anchoring tubing in a bore, the method comprising:

providing first tubing having a section with a wall configured to provide outer surface portions describing a diameter less than a first diameter;

locating the tubing within a bore comprising a first section having an internal diameter greater than the first diameter and a second section having an internal diameter corresponding to the first diameter;

locating the tubing section in the first section of the bore;

reconfiguring the tubing section such that the outer surface portions describe a tubing diameter greater than the first diameter; and axially translating the tubing relative to the bore to locate the tubing section in the second section of the bore such that the outer surface portions are restrained to the first diameter by the bore, and the outer surface portions engage with the bore.

The tubing section is deformed, preferably elastically, when moved into the second section of the bore, and thus the outer surface portions are biased outwardly to engage and grip the bore wall. The axial translation of the tubing, which will typically be achieved by translating the tubing relative to a stationary bore, may be readily achieved simply by pulling or pushing the tubing. Once the tubing section is located within the second section of the bore, static friction will assist in retaining the tubing fixed relative to the bore.

The method of the invention thus provides a convenient method of creating a coupling between a tubing and a surrounding bore wall, which coupling may be utilised to fix the tubing relative to the bore, both axially and rotationally, to facilitate subsequent operations, such as further reconfiguration or deformation of the tubing, or cementation of the tubing in the bore. The outer surface portions of the tubing may be circumferentially spaced, and most preferably are regularly spaced around the circumference of the tubing. Alternatively, the outer surface portions may be defined by a substantially continuous arc or segment. The tubing may initially be circular and in this initial form preferably has an outer diameter at least as large as the first diameter. Portions of the initially circular tubing wall may be reconfigured to a generally planar form such that the tubing is then substantially polygonal, most preferably defining a pentagon or hexagon. The tubing may then be further reconfigured such that the planar tubing wall portions become convex, and are located between the outer surface portions, which describe the tubing maximum diameter, which is less than said first diameter. The tubing may then be passed into the-bore. Alternatively, one or more indents may be formed in the tubing wall, to create one or more convex wall portions such that the tubing defines an outer diameter less than said first diameter. Of course the tubing may be initially created in this form, if desired.

If a radially outwardly directed force is then applied to the one or more convex wall portions, which will typically describe the tubing section minimum diameter, the outer surface portions are urged radially outwards to assume a configuration in which the portions describe a diameter greater than said first diameter.

The provision of one or more convex wall portions facilitates passage of fluid between the tubing section and the surrounding bore, both before and after reconfiguring the tubing section, and even after the tubing section is restrained in the bore, which may be particularly useful if the first tubing is to be cemented in the bore. If desired, the tubing may subsequently be sealed to the bore wall by, for example, reconfiguring the tubing section to a form corresponding to the bore wall or, most preferably, by configuring another section of the tubing to a form corresponding to the bore wall. Most preferably, sealing the tubing with the bore wall is achieved by expanding a section of the tubing, which section may include a seal member. Preferably, the expansion is achieved by means of a rotary expander, that is an expander which is rotatable in the tubing and preferably includes at least one rotating member in rolling contact with the tubing inner wall.

The bore may be a drilled or otherwise formed bore, a section of tubing or pipe, or a combination of both. Preferably, the bore is at least partially defined by downhole bore-lining tubing, such as casing or liner. The bore-lining tubing will typically be unexpandable, for example if the bore-lining tubing has been cemented; the method of the present invention allows the first tubing to be located in such bore-lining tubing while avoiding the difficulties that are inherent in locating tubing by expansion within an unexpandable larger tubing. However, in other embodiments of the invention the bore-lining tubing may experience a degree of expansion, elastic, inelastic or both.

The radially outwardly directed force is preferably created by passing a tubing expander, which may be of conical or tapered form, through the tubing. Preferably, the tubing expander comprises an expansion cone, and most preferably the expander comprises a seal for sealingly engaging the bore wall, such that fluid pressure may be utilised to drive the expander through the tubing section. The expander may have a first configuration in which fluid may pass through or around the expander, and a second configuration in which the expander creates a barrier to fluid flow through the bore. The second configuration may be achieved by locating a ball or plug in a suitable shoe in the expander. The expander may further be adapted to assume a third configuration in which fluid may again flow through or around the expander. The third configuration may be achieved by rupturing a disc, diaphragm or the like, which may be provided in the plug, or by shearing out a ball or plug shoe.

The tubing may itself serve as a hanger, or may be coupled, by any appropriate means, to a hanger to be set following the reconfiguration of the tubing.

A further length of tubing, which may or may not be expandable, may be coupled to the tubing.

The tubing may include a profile for co-operating with a corresponding profile on a running string to allow the string to support the tubing as the tubing is being run into the bore. Preferably, the profile is provided on an upper portion of the tubing, above a notch in the tubing. The area of tubing including the notch may be subject to expansion utilising a rotary expander, which it has been found results in the tubing shearing or otherwise parting at the notch, allowing the portion of tubing defining the profile to be pulled out of the bore, leaving the remainder of the tubing in the bore.

According to a second aspect of the present invention there is provided apparatus for use in anchoring tubing in a section of a bore of a first diameter, the apparatus comprising:

first tubing including a section with a non-circular wall configured to provide an outer surface portion describing a diameter less than the first diameter;

a first expander for expanding the first tubing section wall such that the outer surface portion describes a diameter greater than the first diameter; and means for engaging a running tool for running the tubing into the bore and then locating the expanded tubing section in the first diameter section of the bore.

Preferably, the apparatus further comprises a second expander for expanding a section of the tubing into sealing contact with the bore wall.

According to a further aspect of the present invention there is provided a method of anchoring tubing in a bore, the method comprising:

providing tubing having at least a section of wall configured to provide outer surface portions describing a diameter less than a first diameter;

locating the tubing within a bore having an internal diameter corresponding to said first diameter; and reconfiguring said section of wall such that said outer surface portions are biased to describe a tubing diameter greater than said first diameter but are restrained to said first diameter by said bore, such that said outer surface portions engage the bore.

The method of the invention thus provides a convenient method of creating a coupling between a tubing and a surrounding bore wall, which coupling may be utilised to fix the tubing relative to the bore, both axially and rotationally, to facilitate subsequent operations, such as further reconfiguration or deformation of the tubing.

Preferably, said outer surface portions of the tubing are circumferentially spaced, and most preferably are regularly spaced around the circumference of the tubing. Alternatively, the outer surface portions may be defined by a continuous arc or segment.

Preferably, the tubing is initially circular and most preferably has an outer diameter at least as large as said first diameter. Portions of tubing wall may be reconfigured to a substantially planar form; the tubing is then substantially polygonal, most preferably defining a pentagon or hexagon. The tubing may then be configured such that said tubing wall portions become convex, and are located between said outer surface portions, which describe the tubing maximum diameter, less than said first diameter. The tubing may then be passed into the bore. Alternatively, one or more indents may be formed in the tubing wall, to create one or more convex wall portions such that the tubing defines an outer diameter less than said first diameter.

If a radially outwardly directed force is then applied to the one or more convex wall portions, which may describe the tubing section minimum internal diameter, the outer surface portions are urged radially outwards, into contact with the bore wall. If unrestrained, said outer surface portions would describe a diameter larger than said first diameter, such that there is an interference or contact force between the outer surface portions and the bore.

The bore may be a drilled or otherwise formed bore, or may be a section of tubing or pipe. Preferably, the bore is defined by downhole bore-lining tubing, such as casing or liner.

The radially outwardly directed force is preferably created by passing a tubing expander, which may be a conical or tapered form, through the tubing. Most preferably, the tubing expander comprises a plurality of rollers and the expander is rotatable within the tubing such that the rollers are in rolling contact with the tubing. The tubing expander outer diameter may be less than the inner diameter of the tubing wall at said outer surface portions.

Preferably, reconfiguring said section of wall results in the creation of gaps between the tubing wall and the bore wall, the gaps being located between said outer surface portions. Such gaps may be useful in that they may permit flow of fluid from between the tubing wall and the bore wall when, for example, cement is injected into the annulus between the tubing and the bore wall.

Preferably, the tubing may subsequently be further reconfigured to achieve a substantially circular form, preferably by passing a fluid activated rotary expander through the tubing.

The tubing may itself serve as a hanger, or may be coupled, by any appropriate means, to a hanger to be set following the reconfiguration of the tubing.

A further length of tubing, which may or may not be expandable, may be coupled to the tubing.

The tubing may include a profile for co-operating with a tubing running assembly to allow the assembly to support the tubing as the tubing is being run into the bore.

The reconfiguration of the tubing may be achieved by moving an expander axially through the tubing, and preferably the expander is axially movable relative to the portion of the tubing running assembly co-operating with the tubing profile. The expander may be mounted on a ram.

BRIEF DESCRIPTION OF THE DRAWINGS

These and other aspects of the present invention will now be described, by way of example, with reference to the accompanying drawings, in which:

FIGS. 1 to 5 are schematic illustrations of steps in a method of anchoring tubing in a bore, in accordance with an embodiment of a first aspect of the present invention; and FIGS. 1*a*, 3*a* and 5*a* are sectional view on lines 1*a*—1*a*, 3*a*—3*a* and 5*a*—5*a* of FIGS. 1, 3 and 5, respectively.

DETAILED DESCRIPTION OF THE DRAWINGS

Reference is first made to FIGS. 1 to 5 of the drawings, which illustrates steps in the method of anchoring and subsequently cementing and sealing tubing, in the form of liner 20, in the lower end of a drilled bore 22. In FIG. 1, the liner 20 is shown in the run-in position, with the upper end of the liner 20 overlapping the lower end of existing cemented casing 24. The remainder of the liner 20 is located in unlined, or open bore.

The liner 20 is coupled to a running string 26, formed of drill pipe, by means of co-operating profiles 28. Below the liner profile 28, which is located at the upper end of the liner 20, the liner wall defines a notch 30, the purpose and function of which will be described in due course.

Mounted to the lower end of the string 26, within the liner 20, is a running tool 31 and a rotary expansion tool 32. The expansion tool 32 comprises a hollow body 34 in fluid communication with the string 26, the body 34 accommodating three piston-mounted rollers 36. As will be described, supplying fluid at elevated pressure to the interior of the body 34 tends to urge the rollers 36 radially outwardly, and by then rotating the tool 32 within the liner 20 the internal and external diameters of the liner may be increased. A cement plug catcher 40 is mounted via shear pins to the lower end of the expansion tool 32.

A drillable cone and seal assembly 48 is initially located within a section of the liner 20*a* below the plug catcher 40, which liner section 20*a* has been formed to provide a corrugated or crinkled wall profile, as may be seen from FIG. 1*a* of the drawings. Other than the liner section 20*a*, the liner 20 is of a circular form and has an outer diameter slightly smaller than the inner diameter of the casing 24, to provide sufficient clearance for the liner 20 to be run in through the casing 24. However, the liner section 20*a* has been first shaped into a polygonal form in a forming die and the planar wall portions then further deformed to a concave form such that the outer diameter of the liner section 20*a* is described by six outer surface portions 50. The minimum inner diameter of the section 20*a* is defined by the midpoints of the concave wall portions 51.

The cone and seal assembly 48 comprises a hollow upper cone 52, and a reduced diameter tubular portion 56 extends from the cone 52 to a larger diameter stabiliser collar 58. The collar 58 has an external circumferential seal 54 for engaging the inner wall of the liner 20 and defines an internal ball seat 59. Initially, the assembly 48 is located in the liner 20 as illustrated in FIG. 1, that is with the cone 52 and collar 58 respectively located above and below the crinkled section 20*a*, and the tubular portion 56 extending through the section 20*a*.

The lower end of the liner 20 is provided with a drillable cement shoe 60.

In use, the liner 20 is run into the bore 22 to the position as illustrated in FIG. 1. If desired, fluid may be circulated through the liner 20, and the liner 20 may be rotated within the bore 22 as the liner 20 is run in. Pre-flush fluid may then be pumped from surface down through the running string 26, followed by a ball 62 (FIG. 2) and a volume of cement 64. The ball 62 lands on the seat 59 and closes the throughbore defined by the collar 58. Fluid pressure then acts on the area defined by the seal 54, and urges the collar 58, and of course the remainder of the assembly 48, down through the crinkled section 20*a*. The diameter and profile of the cone 52 are selected such that the cone contacts the inner faces of the concave wall portions 51, which has the effect of moving the outer surface portions 50 radially outwards to describe an increased outer diameter, slightly larger than the internal diameter of the cemented casing 24, as illustrated in FIG. 2. A pressure drop will be evident at surface when the cone 52 clears the lower end of the section 20*a*, and further pumping of cement 64 will continue to push the assembly 48 through the liner 20 until the collar 58 engages the shoe 60.

The volume of cement 64 is followed by a wiper plug 66 and water spacer 68. The plug 66 engages and shears out the plug catcher 40, which is then pushed through the liner 20 until the catcher 40 engages the cone 52 (FIG. 3). Prior to this, a pressure increase will have been applied to shear out the ball seat 59, such that the seat 59 and ball 62 land out within the float shoe 60, allowing the cement 64 to circulate into the annulus 70 between the liner 20 and the open bore 22.

The running string 26 is then lifted from surface, which raises the liner 20 and pulls the now expanded section 20*a* into the lower end of the casing 24, as illustrated in FIG. 3. This requires a degree of elastic deformation of the section 20*a*, as the outer diameter described by the section 20*a* must reduce to allow the section 20*a* to move into the substantially inelastic casing 24. This deformation of the section 20*a* is substantially elastic, such that the spring force created in the section 20*a*, tending to increase the diameter of the section 20*a*, serves to retain the section 20*a* securely within the casing 24.

Weight is then applied to the liner 20 to check the integrity of the thus-formed hanger, before releasing the running tool 31 from the liner 20.

The expansion tool 32 is then lowered into the liner 20, which is now axially fixed relative to the casing 26 by the section 20*a*, until the tool 32 is located above the section 20*a* at a liner seal section 20*b*. Elevated fluid pressure applied through the string 26 to the tool 32 then acts to extend the rollers 36, such that rotation of the string 26 and the activated tool 32 will diametrically expand the liner section 20*b* into sealing contact with the casing 24. Fluid is then pumped through the running string 26 to circulate out cement residue, and the thus-formed hanger is then subject to a pressure test.

The expansion of the liner 20 is then continued over the notch 30, and the expansion at the notch causes the liner 20 to separate. The tool 32, and the short length of liner 20 above the notch 30, may then be pulled out of the bore on the running string 26, as shown in FIG. 5.

In further embodiments, the liner 20 may be cemented after the expanded liner section 20*a* has been pulled back into the casing; the gaps 76 (FIG. 3*a*) that remain between the casing inner wall and the polygonal liner section 20*a* allow for fluid circulation.

In other embodiments of the invention, a profiled liner section may be subject to expansion by a cone and seal assembly or the like while positioned within the lower end of the casing. The outer surface portions of the expanded liner section, if unrestrained by the surrounding casing, would assume a larger diameter. Accordingly, the restraint provided by the casing results in the liner section outer surface portions engaging the casing, allowing the liner to be hung from the casing while providing gaps between the liner and casing to permit fluid circulation.

In other embodiments of the invention, the principle of utilising elastic deformation of a profiled or otherwise shaped tubing to create a tubing coupling may be used without the initial steps of running the tubing into a larger diameter section of the bore, expanding or reconfiguring the tubing, and then translating the reconfigured tubing into a smaller diameter section of the bore. In other words, the tubing may be run into the bore in a configuration in which the outer surface portions already describe a diameter greater than the internal diameter of the bore section in which the tubing is to be received. The tubing is therefore pushed into the bore section and will immediately be in engagement with the bore section, the degree of friction between the tubing and the bore wall being sufficient to retain the tubing in the bore. Alternatively, further means for retaining the tubing relative to the bore wall may also be provided. Of course, it is also possible to form a section of the bore wall to define inner profile portions, which are elastically deformed when tubing is pushed or pulled into the bore section and thus grip the tubing. The profiled section may subsequently be reformed by expansion of the tubing, which expansion in turn reforms the bore wall.

What is claimed is:

1. A method of anchoring tubing in a bore, the method comprising:

providing first tubing having a section with a wall configured to provide outer surface portions describing a diameter less than a first diameter;

locating the tubing within a bore comprising a first section having an internal diameter greater than the first diameter and a second section having an internal diameter corresponding to the first diameter;

locating the tubing section in the first section of the bore;

reconfiguring the tubing section such that the outer surface portions describe a tubing diameter greater than the first diameter; and axially translating the tubing relative to the bore to locate the tubing section in the second section of the bore such that the outer surface portions are restrained by the bore.

2. The method of claim 1, wherein the tubing section is elastically deformed when moved into the second section of the bore.

3. The method of claim 1, wherein the tubing is axially translated relative to a stationary bore.

4. The method of claim 1, wherein the tubing is translated by pulling the tubing.

5. The method of claim 1, comprising forming the first tubing section by:

providing tubing having a substantially circular section wall;

reconfiguring portions of the tubing wall to a generally planar form such that the tubing is then substantially polygonal, and then further reconfiguring the planar tubing wall portions to form convex wall portions, located between outer surface portions.

6. The method of claim 1, comprising forming the first tubing section by:

providing tubing having a substantially circular section wall, and forming at least one axially extending indent in the tubing wall.

7. The method of claim 5, comprising reconfiguring the tubing section by applying a radially outwardly directed force to at least one convex wall portion to urge the outer surface portion radially outwards to assume a configuration in which the tubing section describes a diameter greater than said first diameter.

8. The method of claim 1, further comprising passing fluid between the reconfigured tubing section and the surrounding bore.

9. The method of claim 1, further comprising cementing the tubing in the bore.

10. The method of claim 1, further comprising sealing at least a portion of the tubing in the bore.

11. The method of claim 10, comprising sealing said portion of the tubing in the bore by reconfiguring the tubing section to a form corresponding to the bore wall.

12. The method of claim 10, comprising sealing the portion of the tubing to the bore wall by configuring another section of the tubing to a form corresponding to the bore wall.

13. The method of claim 10, comprising sealing the portion of the tubing to the bore wall by expanding a section of the tubing.

14. The method of claim 13, comprising expanding the tubing using a rotary expander.

15. The method of claim 1, wherein the bore comprises an unlined drilled bore.

16. The method of claim 1, wherein the bore comprises a section of tubing-lined bore.

17. The method of claim 1, wherein the first section of the bore comprises unlined drilled bore and the second section of the bore comprises a tubing-lined section of drilled bore.

18. The method of claim 16, wherein the bore-lining tubing is substantially unexpandable.

19. The method of claim 1, wherein the tubing section is reconfigured such that the outer surface portions describe a tubing diameter greater than the first diameter by applying a radially outwardly directed force to at least a portion of the tubing section.

20. The method of claim 19, wherein the radially outwardly directed force is created by passing a tubing expander through the tubing.

21. The method of claim 20, wherein the tubing expander comprises an expansion cone.

22. The method of claim 20, wherein the tubing expander comprises a seal for sealingly engaging the bore wall, and further comprising utilising fluid pressure to drive the expander through the tubing section.

23. The method of claim 22, comprising providing the tubing expander in a first configuration in which fluid may pass the expander, and then reconfiguring the expander to a second configuration in which the expander creates a barrier to fluid flow.

24. The method of claim 23, further comprising reconfiguring the expander to a third configuration in which fluid may again pass the expander.

25. The method of claim 1, further comprising providing a profile in the tubing for co-operating with a corresponding profile on a running string to allow the string to support the tubing as the tubing is being run into the bore.

26. The method of claim 25, further comprising providing the profile on an upper portion of the tubing, above a notch in the tubing, and subjecting the area of tubing including the notch to expansion utilising a rotary expander to part the tubing at the notch.

27. Apparatus for use in anchoring tubing in a first section of a bore of a first diameter, the apparatus comprising:

a first tubing including a section with a non-circular wall configured to provide an outer surface portion describing a diameter less than the first diameter;

a first expander for diametrically expanding the first tubing section wall disposed in a second section of the bore of a second larger diameter such that the outer surface portion describes a diameter greater than the first diameter; and a running tool for running the tubing into the bore and then locating the expanded tubing section in the first diameter section of the bore.

28. The apparatus of claim 27, wherein the first expander comprises an expansion cone.

29. The apparatus of claim 27, wherein the first expander comprises a seal for sealingly a wall of the first tubing, such that fluid pressure may be utilised to drive the expander through the tubing.

30. The apparatus of claim 27, wherein the first expander has a first configuration in which fluid may pass the expander, and a second configuration in which the expander creates a barrier to fluid flow.

31. The apparatus of claim 27, wherein the apparatus further comprises a second expander, for expanding a section of the tubing into sealing contact with the bore wall.

32. The apparatus of claim 31, wherein the second expander is a rotary expander.

33. The apparatus of claim 27, wherein the tubing section comprises circumferentially spaced outer surface portions.

34. The apparatus of claim 33, wherein the outer surface portions are regularly spaced around the circumference of the tubing.

35. The apparatus of claim 27, wherein the outer surface portion of the tubing section is defined by a substantially continuous arc.

36. The apparatus of claim 27, wherein the tubing section comprises at least one convex wall portion located between outer surface portions.

37. The apparatus of claim 27, wherein a section of the tubing includes a seal member.

38. The apparatus of claim 27, in combination with bore-lining tubing of said first diameter.

39. The apparatus of claim 27, wherein the first tubing comprises a tubing hanger.

40. The apparatus of claim 27, further comprising an internal profile in the first tubing for engaging with the running tool.

41. The apparatus of claim 39, wherein the profile is provided on an upper portion of the first tubing, above a notch in the tubing.

42. A method of anchoring tubing in a bore, the method comprising:

providing tubing having a corrugated wall section configured to provide at least one outer surface portion describing an outer diameter greater than a first diameter; and locating the tubing within an area of a bore having an internal diameter corresponding to the first diameter such that the outer surface portion is restrained to the first diameter by the bore, wherein the locating includes axially moving the tubing in the bore to move the corrugated wall section that is preformed with the outer diameter that is greater than the first diameter into the area of the bore.

43. The method of claim 42, wherein a wall section of the tubing is configured to define said at least one outer surface portion.

44. The method of claim 42, wherein the tubing section is at least elastically deformed when moved into the area of the bore.

45. The method of claim 42, further comprising passing fluid between the tubing and the bore.

46. The method of claim 42, further comprising reforming the tubing section within the area of the bore such that an outer surface of the tubing section substantially conforms to the inner surface of the area of the bore.

47. A method of anchoring tubing in a bore, the method comprising:

providing tubing having a corrugated wall section describing an outer diameter greater than a first diameter; and locating the tubing within an area of a bore having at least one inner surface portion describing an internal diameter corresponding to the first diameter such that the inner surface portion engages with the tubing, wherein the locating includes axially moving the tubing in the bore to move the corrugated wall section that is preformed with the outer diameter that is greater than the first diameter into the area of the bore.

48. The method of claim 47, wherein, on locating the tubing within the area of said bore, the inner surface portion of the bore is extended beyond the first diameter by the tubing.

49. A method of anchoring tubing in a bore, comprising:

providing first tubing having a tubing section with a wall configured to provide at least one outer surface portion describing a diameter less than a first diameter;

locating the tubing within a bore comprising a first section having an internal diameter greater than the first diameter and a second section having an internal diameter corresponding to the first diameter;

locating the tubing section in the first section of the bore;

reconfiguring the tubing section such that the at least one outer surface portion describes a tubing diameter greater than the first diameter; and axially translating the tubing relative to the bore to locate the tubing section in the second section of the bore such that the at least one outer surface portion is restrained by the bore.

50. The method of claim 49, wherein the tubing section is elastically deformed when moved into the second section of the bore.

51. The method of claim 49, wherein the tubing is axially translated relative to a stationary bore.

52. The method of claim 49, further comprising cementing the tubing in the bore.

53. The method of claim 49, further comprising sealing at least a portion of the tubing in the bore.

54. The method of claim 53, further comprising sealing said portion of the tubing in the bore by reconfiguring the tubing section to a form corresponding to a wall of the bore.

55. The method of claim 53, comprising sealing the portion of the tubing to a wall of the bore by configuring another section of the tubing to a form corresponding to the wall of the bore.

56. The method of claim 49, wherein the tubing section is reconfigured such that the outer surface portions describe a tubing diameter greater than the first diameter by applying a radially outwardly directed force to at least a portion of the tubing section.

57. The method of claim 56, wherein the radially outwardly directed force is created by passing a tubing expander through the tubing.

58. The method of claim 57, wherein the tubing expander comprises an expansion cone.

59. The method of claim 57, wherein the tubing expander comprises a seal for sealingly engaging the bore wall, and further comprising utilizing fluid pressure to drive the expander through the tubing section.

60. The method of claim 49, further comprising providing a profile in the tubing for co-operating with a corresponding profile on a running string to allow the string to support the tubing as the tubing is being run into the bore.

61. The method of claim 60, further comprising providing the profile on an upper portion of the tubing, above a notch in the tubing, and subjecting the area of tubing including the notch to expansion utilizing a rotary expander to part the tubing at the notch.

* * * * *